United States Patent [19]

Collin

[11] 4,113,094

[45] Sep. 12, 1978

[54] CONTAINER FOR CUT FLOWERS

[76] Inventor: Herbert S. Collin, 35 Stillings St., Boston, Mass. 02210

[21] Appl. No.: 788,333

[22] Filed: Apr. 18, 1977

Related U.S. Application Data

[62] Division of Ser. No. 700,342, Jun. 28, 1976, abandoned.

[51] Int. Cl.[2] ..... B65D 85/50

[52] U.S. Cl. ..... 206/423; 47/41 R; 206/515; 220/70

[58] Field of Search ..... 206/423, 519, 520, 515, 206/527; 220/20, 72, 70, 69; 47/41 R, 66, 71, 86

[56] References Cited

U.S. PATENT DOCUMENTS

| | | | |
|---|---|---|---|
| 2,493,633 | 1/1950 | Mart | 206/519 |
| 2,677,350 | 5/1954 | Prestidge et al. | 220/20 |
| 3,083,824 | 4/1963 | Ness | 206/423 |
| 3,521,808 | 7/1968 | Weiss | 220/72 |

*Primary Examiner*—William T. Dixson, Jr.
*Attorney, Agent, or Firm*—Wolf, Greenfield & Sacks

[57] ABSTRACT

A shipping and display container for cut flowers includes a stackable box having means for supporting a partly filled bucket of water in which the stems of the cut flowers are placed. The box is formed from a blank which, when folded to the box configuration, effects an improved seal at the lower corner regions of the box to retard leaking of water from the box. A false bottom holds the bucket in place. In an alternative embodiment of the invention, the flower bucket is molded from plastic and has integral side flanges which extend downwardly from the mouth of the bucket in a somewhat pyramid shape to define a self-supporting arrangement for the bucket. The lower edges of the flanges are upturned to provide a water receptive trough to retard leakage of water from the box.

3 Claims, 11 Drawing Figures

CONTAINER FOR CUT FLOWERS

This is a (division) of application Ser. No. 700,342, filed June 28, 1976 now abandoned.

BACKGROUND AND SUMMARY OF THE INVENTION

This invention relates to the handling, transportation and display of cut flowers and, particularly, to an improved container therefor.

Cut flowers are highly perishable and, once cut, must be shipped to the point of sale as soon as possible. It is essential, in order to maintain the flowers in a fresh condition, to keep their cut stems in water and it also is essential to protect the flowers themselves from damage which may occur from handling. Typically, cut flowers simply are inserted into an open-top bucket which is partly filled with water and a plurality of such flower-filled buckets are shipped to an appropriate commercial outlet where they are displayed for sale. Usually, the flowers are shipped by truck.

The foregoing common practice is far from ideal and presents a number of difficulties. For example, it is not uncommon for much of the water in the flower buckets to spill during transportation. The flowers themselves have little, if any, protection. They cannot be stacked on top of each other which usually results in most of the useable space in the truck being unused. Also, the flowers are handled directly which increases the chances of their being damaged.

It is among the general objects of the invention to provide an improved container for cut flowers which overcomes the foregoing difficulties. In brief, the invention includes a box which may be made from a corrugated cardboard blank which is formed so that when the blank is folded to the box configuration, the bottom corners of the box will define an improved seal to retard leaking of water from the box in the event that water does spill out of the flower bucket. In one embodiment of the invention, the box has a false bottom platform with a hole therein to receive the flower bucket and hold the flower bucket firmly in place. The box is of a height sufficient to fully enclose and protect the flowers themselves. The inner surfaces of the box are coated with a water-impervious film. Handle holes are provided in the box as are knock-out panels to enable air circulation through the box to be controlled. The boxes containing the flowers may be stacked side by side and on top of each other to make the most efficiency of the available capacity of the truck or other shipping vehicle. The box also is arranged so that when it is at the point of sale, its top and portions of its side and front panels can be removed to present a convenient and aesthetically appealing display for the flowers.

In another embodiment of the invention, the flower bucket is molded from plastic and is self-supporting in the box by means of a surrounding skirt which extends downwardly from the mouth of the container to the level of the bottom of the bucket. The lower edge of the skirt is rectangular and is dimensioned to fit within the bottom of the box to stabilize the bucket in the box. The lower edge of the skirt has an upturned portion to define a water-receptive trough for water which may inadvertently spill out of the flower bucket.

It is among the general objects of the invention to provide an improved device for shipping and displaying cut flowers.

Another object of the invention is to provide a shipping and display container for cut flowers which minimizes leakage of water from the container.

A further object of the invention is to provide a shipping container for cut flowers which is stackable to facilitate shipping of large quantities of flowers and which protects the flowers from damage in handling.

DESCRIPTION OF THE DRAWINGS

The foregoing and other objects and advantages of the invention will be appreciated more fully from the following further description thereof, with reference to the accompanying drawings wherein.

DESCRIPTION OF THE PREFERRED EMBODIMENT

Figure 1:
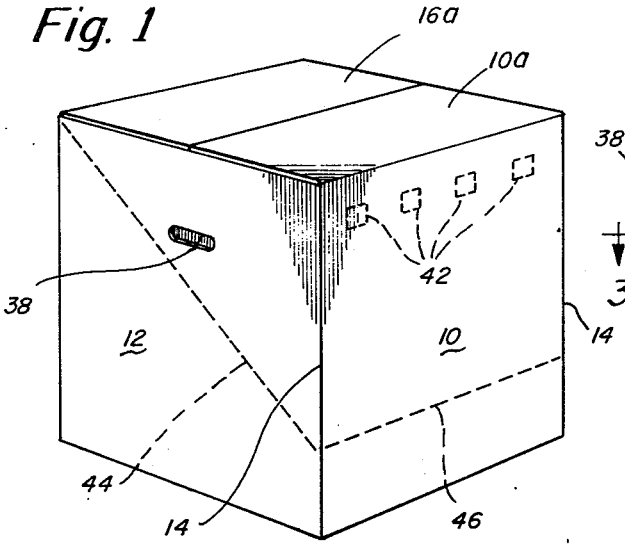
FIG. 1 is an illustration of the box when closed.
Figure 2:
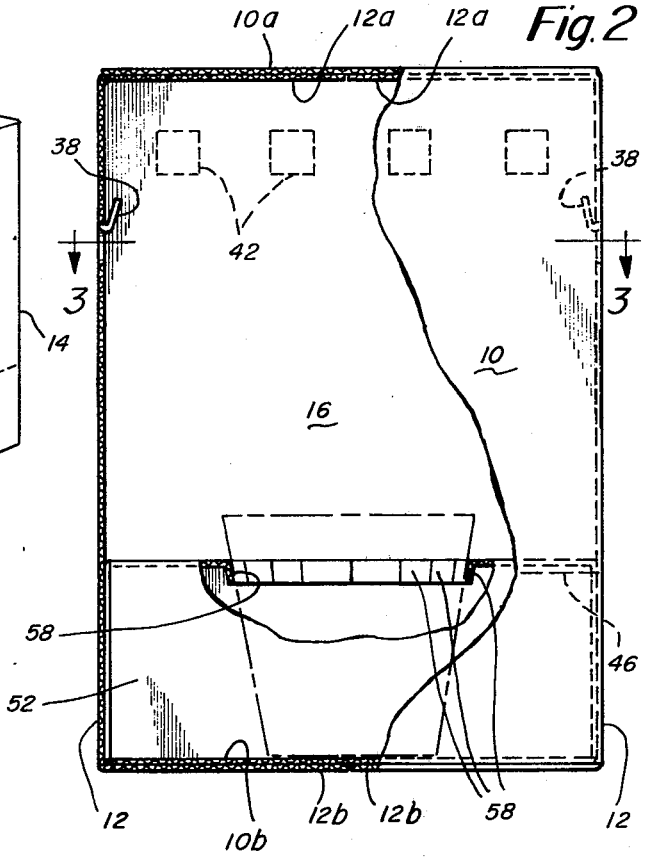
FIG. 2 is a side elevation, in section, of the box.
Figure 3:
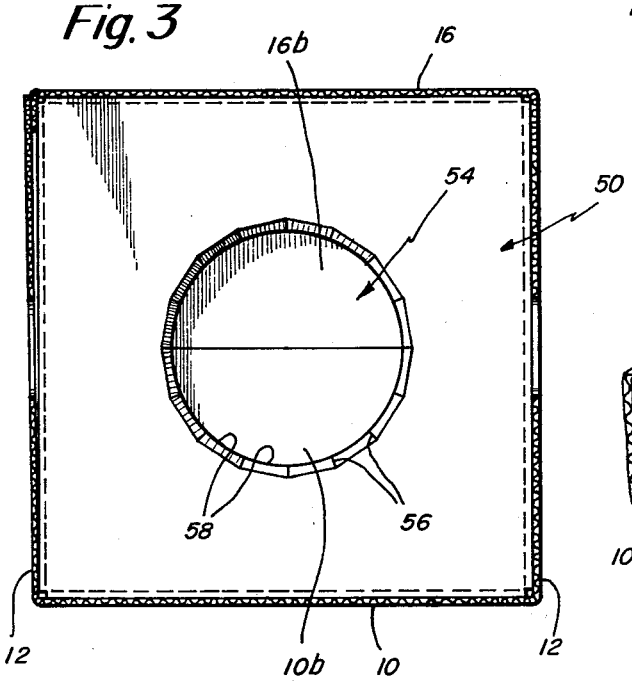
FIG. 3 is a plan sectional illustration of the box as seen along the line 3—3 of FIG. 2.
Figure 8:
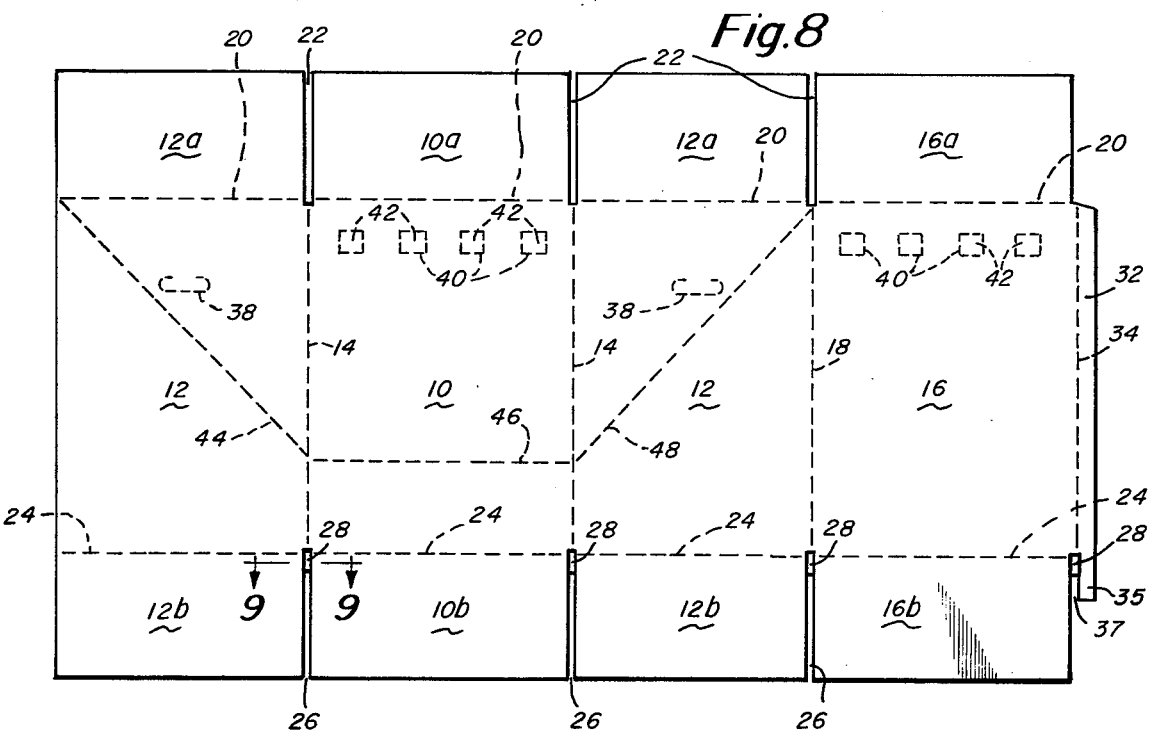
FIG. 8 is a plan view of the blank from which the box shown in FIGS. 1–6 is formed.
Figure 9:
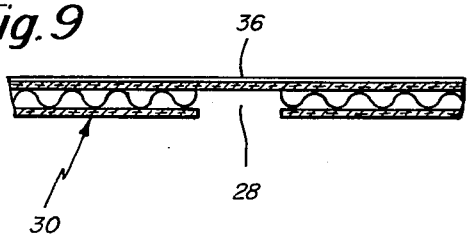
FIG. 9 is an enlarged sectional illustration of that portion of the blank by which the leak-resistant corner is formed when the box is folded to its assembled configuration as seen along line 9—9 of FIG. 8.

FIG. 1 shows the box which is made fom the blank shown in FIG. 8. The blank is made from cardboard, preferably corrugated, and includes a front panel 10, side panels 12 which are attached to the opposite ends of the front panel along fold lines 14, and a rear panel 16 which is attached to one of the side panels 12 along a fold line 18. Each of the panels 10, 12, 16 has a top flap **10*a*, 12*a*, 16*a*, respectively, which extend from and are defined from their respective panels by fold lines 20. The adjacent top flaps 10*a*, 12*a*, 16*a* are separated by slots 22. Each of the panels 10, 12, 16 also has a corresponding bottom flap, identified respectively at 10*b*, 12*b* and 16*b* as shown in FIG. 8. The bottom flaps 10*b*, 12*b*, 16*b* similarly extend from and are defined with respect to their associated panels by fold lines 24. The adjacent bottom flaps 10*b*, 12*b*, 16*b* are separated by slots 26 similar to the top flap slots 22 except that the innermost region of the slots 26 is not cut fully through the cardboard. Rather, as shown in FIG. 9, the inner end of each of the slots is only cut through partially to leave a web 28 which is defined by the inner sheet 30 (see FIG. 5) of the corrugated cardboard. As described below, the web 28** forms an internal leak-resistant corner when the blank is folded to the box configuration.

The rear panel 16 has a side flap 32 extending from its outer side edge, the flap 32 being foldable along a fold line 24 so that it may be attached, as by staples and/or glue to the free side edge of one of the side panels 12. The side flap 32 extends from the upper end of the panel 16, downwardly along the fold line 34, and its lower end terminates in a downwardly extending tab 35 which protrudes beyond the lower fold line 24 of the panel 16. The tab 35 is spaced from the adjacent edge of the bottom flap 16*b*, as indicated at 37 and a web 28, substantially identical to the webs associated with the slots 26 extends between the adjacent edges of the bottom flap 16*b* and the tab 35.

The surface of the blank which is to face inwardly of the box preferably is coated with a thin film 36 of plastic material which is impervious to water. In order to facilitate handling of the assembled box, the side panels 12 preferably have serrations defining a hand grip tab 38 which can be pushed into the box and folded upwardly to define hand grip holes on the sides of the box. Each of the front and rear panels 10, 16 preferably include a plurality of serrated regions 40 which define a plurality of knock-out windows 42. One or more of the regions 42 may be manually knocked or pushed out on each of the front or rear panels 10, 16 to define ventilation holes, if desired. In this regard, there may be instances where it is preferred that there be no ventilation and in other instances, it may be desirable to have maximum ventilation. The plurality of knock-out portions 42 on the opposite front and rear panels 10, 16 provides considerable latitude of ventilation control. The knock-out regions 42 preferably are disposed in close proximity to the upper end of the front and rear panels 10, 16 and are equally spaced as shown.

It also is preferred to provide line markings on the outwardly facing surfaces of each of the side and front panels as indicated at 44, 46 and 48 in FIG. 8. The lines 44, 46, 48 provide an indication as to where the box may be cut to detach its top and portions of its front and side panels so that the box may then be used in its display configuration suggested in FIG. 6. The line marking 46 on the front panel is substantially horizontal and is spaced from the bottom fold line 24. The line markings 44, 48 associated with the side panels 12 extend from the opposite ends of the line marking 46 upwardly toward the opposite corners of the side panels 12 which will be adjacent the rear panel 16 when the box is in its assembled configuration.

Figure 5:
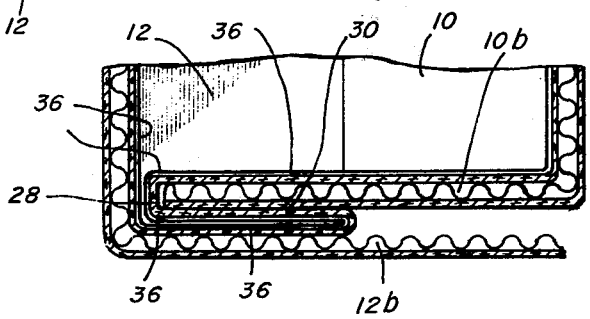
FIG. 5 is an illustration of the leak-resistant corner as seen along the line 5—5 of FIG. 4.
Figure 6:
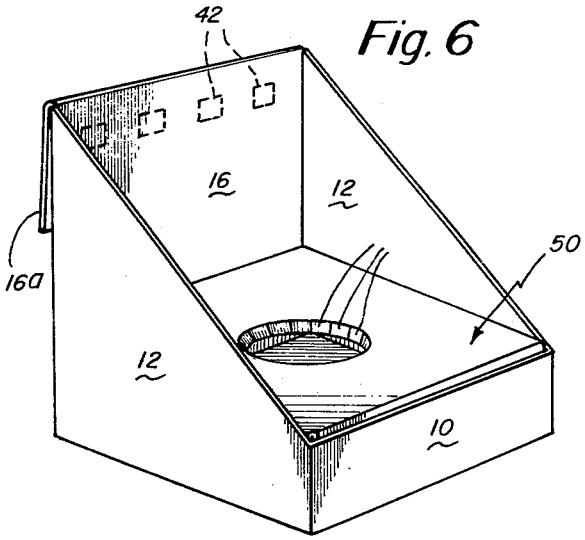
FIG. 6 is an illustration of the box with its top front section removed to display the flowers.
Figure 7:
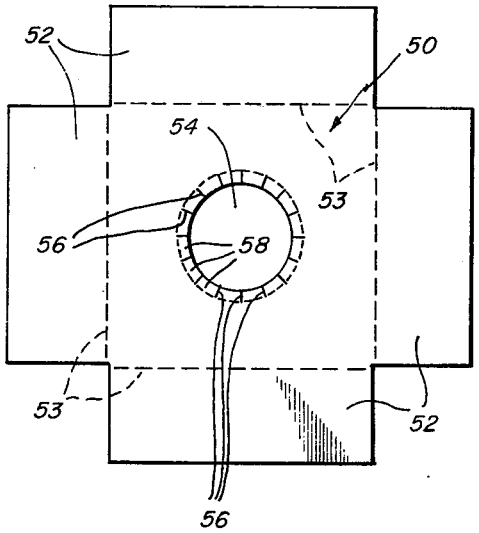
FIG. 7 is a plan view of the blank from which the false bottom of the box shown in FIGS. 1–6 is formed.

In the embodiment shown in FIGS. 1–7, the flower bucket (shown in phantom in FIG. 2) is received and stabilized by a false bottom wall indicated generally by the reference character 50. The false bottom wall 50 may be formed from a blank as shown in FIG. 7 having a central, substantially square panel with a plurality of flaps 52 extending therefrom. Flaps 52 are bent downwardly along fold lines 54 and the false bottom is inserted into the bottom of the assembled box. The false bottom 50 has a central hole 54 to receive the tapered flower bucket and the hole is surrounded by a plurality of circumferentially spaced, radially extending slots 56 to define a plurality of inwardly extending tabs or fingers 58. The fingers 58 are resiliently deformable so that when the tapered flower bucket is inserted downwardly through the hole 54 in the flase bottom 50, the fingers 58 will engage the sides of the flower bucket and help to hold it firmly in place. It should be noted that the upwardly facing surface of the false bottom and the corresponding surfaces of the tabs 52 preferably are also coated with a water-impervious plastic film.

It may be noted that the height of the flaps 52 is substantially equal to the distance between the line marking 46 on the front panel 10 and the bottom fold line 24 of the front panel 10 so that when the upper front portion of the box is removed as suggested in FIG. 6, the false bottom 50 will be in line and at substantially the same level as the remaining bottom segment of the front panel 10. The extension of the flaps 52 also should be slightly less (for example, a few inches) than the height of the flower bucket as suggested in FIG. 2 so that when the flower bucket rests on the bottom of the box, its rim will extend above the false bottom 50.

Figure 4:
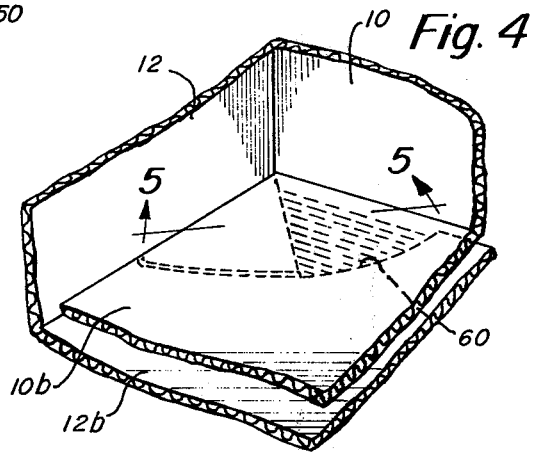
FIG. 4 is an enlarged illustration of one of the leak-resistant corners of the assembled box as seen from the interior of the box.

FIGS. 4 and 5 illustrate the manner in which the webs 28 define a leak-resistant internal corner when the box is assembled from the blank. For example, FIGS. 4 and 5 may be considered as a view of the bottom corner between the front panel 10 and one of the adjacent side panels 12. The panels 10 and 12 are folded along their vertical fold line 14 and, at the same time, the bottom flaps 10*b*, 12*b* are folded along their respective fold lines 24 so that one of the flaps underlies the other. As suggested in FIGS. 4 and 5, the flap 12*b* underlies the flap 10*b*. When the panels and flaps are folded to define the corner, the web portion 28 wraps about the end of the overlying flap 10*b* and, as flap 10*b* is drawn toward panel 12, a portion of the inner skin 30 of the bottom panel 12*b* which is contiguous with the web 28 is torn away from its corrugations as suggested at 60 in FIG. 4. This results in a somewhat triangularly shaped corner region which lies between the flaps 10*b* and 12*b*. As shown in FIG. 5, the inner sheet 30 assumes a somewhat S-shaped, cross-sectional configuration. Any water which might seep into the triangular region is retarded from flowing out at the corner because the folded-over web and internal skin portions of the flaps 10*b*, 12*b* and panels 10, 12 are uninterrupted. The bottom corner region at the juncture of the rear panel 16 and side panel 12 (which are attached to each other by the side flap 32) is effected in the same manner, by folding the tab 35 so that it overlies the adjacent bottom flap 16*b* of the panel 16.

Figure 10:
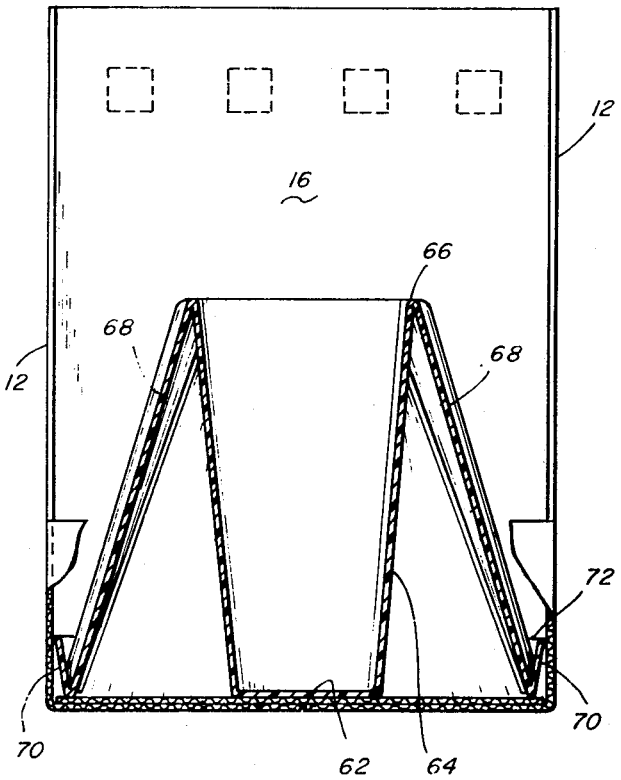
FIG. 10 is a sectional elevation of a modified form of the invention.
Figure 11:
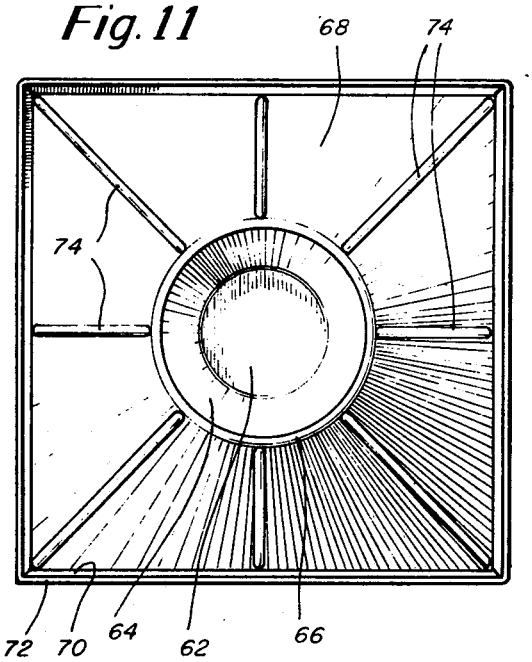
FIG. 11 is a plan view of the embodiment shown in FIG. 10.

FIGS. 10 and 11 show an alternate embodiment of the invention in which the false bottom is omitted in its entirety. In this embodiment of the invention, the box is substantially the same as that described previously although it is not strictly essential to employ the corner construction illustrated in FIGS. 4 and 5. In this embodiment, the flower bucket is molded from a single piece of plastic and has a bottom wall 62 adapted to rest on the bottom of the box and sidewall 64 which extends upwardly from the bottom 62 and terminates at its upper end in an upper rim 66. The flower bucket preferably is tapered downwardly so that its mouth is larger in diameter than the bottom wall 62. The flower bucket includes a skirt which extends contiguously from the rim 66 downwardly and outwardly about the bucket in somewhat of a pyramid configuration. The lower edge of the skirt extends to the same level as the bottom wall 62 of the bucket and is of generally rectangular shape so that it can fit within the bottom of the box. The skirt 68 thus cooperates with the interior of the box bottom to stabilize and rigidify the flower bucket. It may be desirable to provide an upwardly extending reverted flange 70 at the lower end of the skirt to define a V-shaped trough 72 which can receive water which may spill and preclude the water from leaking out of the box. When the flange 70 is employed, it should extend upwardly and outwardly with respect to the skirt, as shown, and the upper edge of the flange 70 should engage the internal surfaces of the box panels. The bucket side wall 64, skirt 68 and flange 70 are arranged so that a plurality of such one-piece molded devices may be nested for storage until ready for use. Preferably, the skirt 68 is formed to include a plurality of heightwise extending ribs 74 to enhance the rigidity of the structure.

Thus, it will be appreciated that the foregoing arrangements provide stability and protection for the fragile cut flowers and in a manner which enables them to be shipped in a stacked, economical configuration and with minimul chance of water leaking from the containers. The flowers are protected at all times and can be ventilated as desired. Moreover, when the package is delivered to the point of sale, its upper front portions may be cut away to expose the flowers and present them in a saleable display arrangement.

It should be understood that the foregoing description of the invention is intended merely to be illustrative thereof and that other modifications and embodiments may be apparent to those skilled in the art without departing from its spirit.

Having thus described the invention, what I desire to claim and secure by Letters Patent is:

1. A container for shipping and displaying cut flowers comprising:

a generally rectangular box having a front wall, a rear wall, a pair of sidewalls and top and bottom walls;

an insert, receivable in the bottom of the box, said insert being molded from a single piece of plastic, said insert including a central flower-receiving bucket portion including a bottom wall and upwardly diverging sidewall, said sidewall terminating at its upper end in a open mouth; a skirt extending from the upper end of the sidewall downwardly and outwardly about the central flower-receiving portion to define a generally pyramid-shaped support, the lower end of the skirt being of rectangular configuration and being disposed at the level of the bottom wall of the central bucket portion to enable the bucket and lower ends of the skirt to rest on the bottom wall of the box, the peripheral configuration of the lower end of the skirt corresponding to that of the bottom of the box; a flange extending about the lower end of the skirt, the flange extending upwardly and outwardly therefrom to define a trough about the lower end of the skirt; the peripheral configuration and dimensions of the upper edge of the flange corresponding to that defined by the sidewalls of the box, the upper edge of the flange being in engagement with the inner surfaces of the sidewalls of the box and the corners defined at the juncture of the sidewalls of the box; and means forming a plurality of heightwise extending ribs on the skirt.

2. A device for use in the shipping and display of cut flowers within a generally rectangular box comprising:

a central flower-receiving bucket portion including a bottom wall and upwardly diverging side wall, said side wall terminating at its upper end in an open mouth;

a skirt extending from the upper rim of the side wall downwardly, outwardly and about the central flower-receiving portion to define a generally pyramid-shape support, the lower end of the skirt being of rectangular configuration and being disposed at the level of the bottom wall of the central bucket portion, the device being receivable within the bottom of a box with the bottom wall of the central portion and the lower end of the skirt portion resting on the bottom of the box;

a flange extending about the lower end of the skirt, the flange extending upwardly and outwardly therefrom to define a trough about the lower end of the skirt, said central portion, skirt and flange being arranged to be nestable with identical of such devices; and the peripheral configuration and dimensions of the upper edge of the flange corresponding to that defined by the heightwise extending walls of the box, the device being receivable in the box with the upper edge of the flange engaging the inner surfaces of the heightwise extending sidewalls and corners of the box to stabilize the device within the box.

3. A device as defined in claim 2 further comprising:

said device being molded from a single piece of plastic and having a plurality of heightwise extending ribs formed on the skirt.

* * * * *